US005207790A

United States Patent [19]

Eveillard

[11] Patent Number: 5,207,790

[45] Date of Patent: May 4, 1993

[54] BILLIARD TABLE WITH CONCAVE EDGES

[75] Inventor: Jacques Eveillard, Evreux, France

[73] Assignee: Philippe Eveillard, Corsept, France; a part interest

[21] Appl. No.: 855,051

[22] Filed: Mar. 18, 1992

[30] Foreign Application Priority Data

Mar. 18, 1991 [FR] France ..... 91 03248

[51] Int. Cl.[5] ..... A63D 15/00

[52] U.S. Cl. ..... 273/3 A

[58] Field of Search ..... 273/3 R, 3 A, 6, 2

[56] References Cited

U.S. PATENT DOCUMENTS 476,324 6/1892 Starks ..... 273/2
3,715,123 2/1973 Baum ..... 273/2
3,841,632 10/1974 Schwartz .

FOREIGN PATENT DOCUMENTS 229381 2/1909 Fed. Rep. of Germany .
368464 11/1906 France .
636378 4/1928 France .
20122 12/1890 United Kingdom ..... 273/3 R
2211101 6/1989 United Kingdom .

*Primary Examiner*—Theatrice Brown
*Attorney, Agent, or Firm*—Young & Thompson

[57] ABSTRACT

A billiard table has a substantially planar playing surface (2), preferably rectangular, limited at its periphery by retention edges (3), and bordered longitudinally by a concave playing surfaces (1) disposed between the planar playing surface (2) and the longitudinal retention edges (3). The concave playing surfaces (1) has a radius of curvature R comprised between 0.30 and 1.1 meter. The center C of the circle determining the radius of curvature R is situated on a straight line D perpendicular to the planar playing surface (2) and passes through a point of intersection between the planar playing surface (2) and the concave playing surface (1).

5 Claims, 3 Drawing Sheets

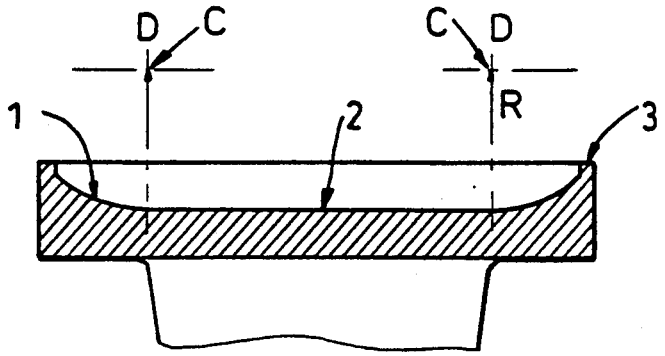
FIG. 2
FIG. 3
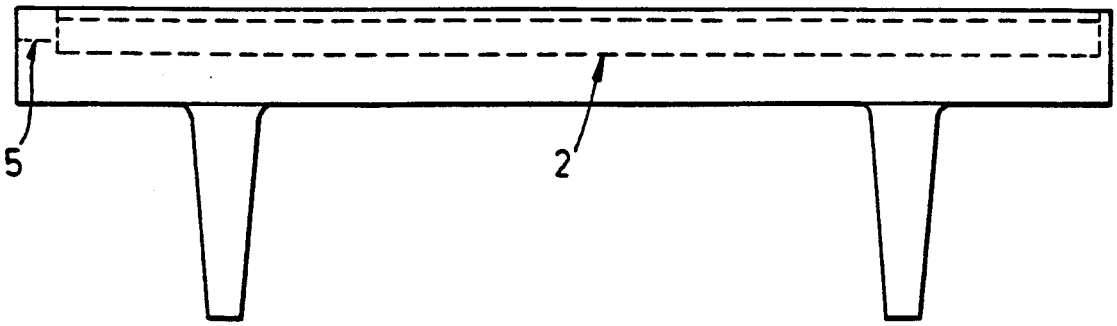
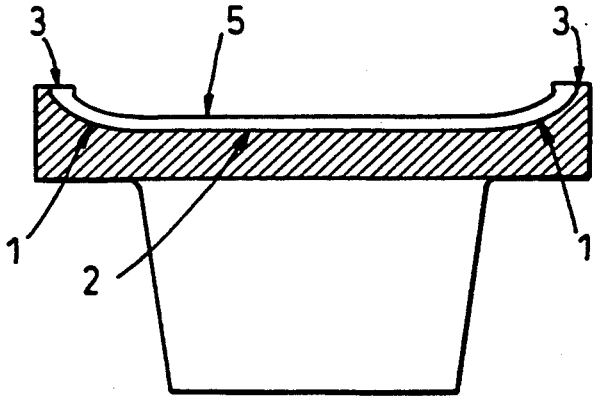
FIG. 4

BILLIARD TABLE WITH CONCAVE EDGES

FIELD OF THE INVENTION

The present invention relates to billiards, particularly a billiard table, having a substantially planar playing surface, preferably rectangular, limited peripherally by retaining edges, and bordered longitudinally by a concave planar surface disposed between the flat playing surface and the longitudinal retaining edges.

BACKGROUND OF THE INVENTION

Many types of billiard tables are known. They generally have a planar playing surface bordered by elastic retention edges called strips. Similarly, there are known billiard tables provided with openings along the longitudinal axis of the playing surface and with one or more projections adapted to modify the trajectory of the balls. Each opening corresponds to a predetermined number of points.

SUMMARY OF THE INVENTION

The object of the present invention is therefore to provide a billiard table of a new type permitting the use of new playing rules from known accessories of the game of billiards, such as the balls and the cues.

For this purpose, the invention relates to billiards, particularly a billiard table, having a substantially planar playing surface, preferably rectangular, delimited at its periphery by retention edges, and bordered longitudinally by a concave playing surface disposed between the planar playing surface and the longitudinal retention edges, characterized in that said concave playing surface has a radius of curvature comprised between 0.30 and 1.1 meter, the center of the circle determining said radius of curvature being located on a straight line perpendicular to the planar surface and passing through the point of intersection between the planar playing surface and the concave playing surface.

According to another characteristic of the invention, the planar playing surface has a width comprised between 0.50 and 1.50 meter.

BRIEF DESCRIPTION OF THE DRAWINGS

Other characteristics and advantages of the present invention will become apparent from a reading of the detailed description and the accompanying drawings, which description and drawings are given only by way of example.

FIG. 2 shows a cross sectional view on the line A—A of FIG. 1;

FIG. 3 shows a side view of the table of FIG. 1;

FIG. 4 shows a cross sectional view on the line B—B of FIG. 1;

DETAILED DESCRIPTION OF THE INVENTION

Figure 1:
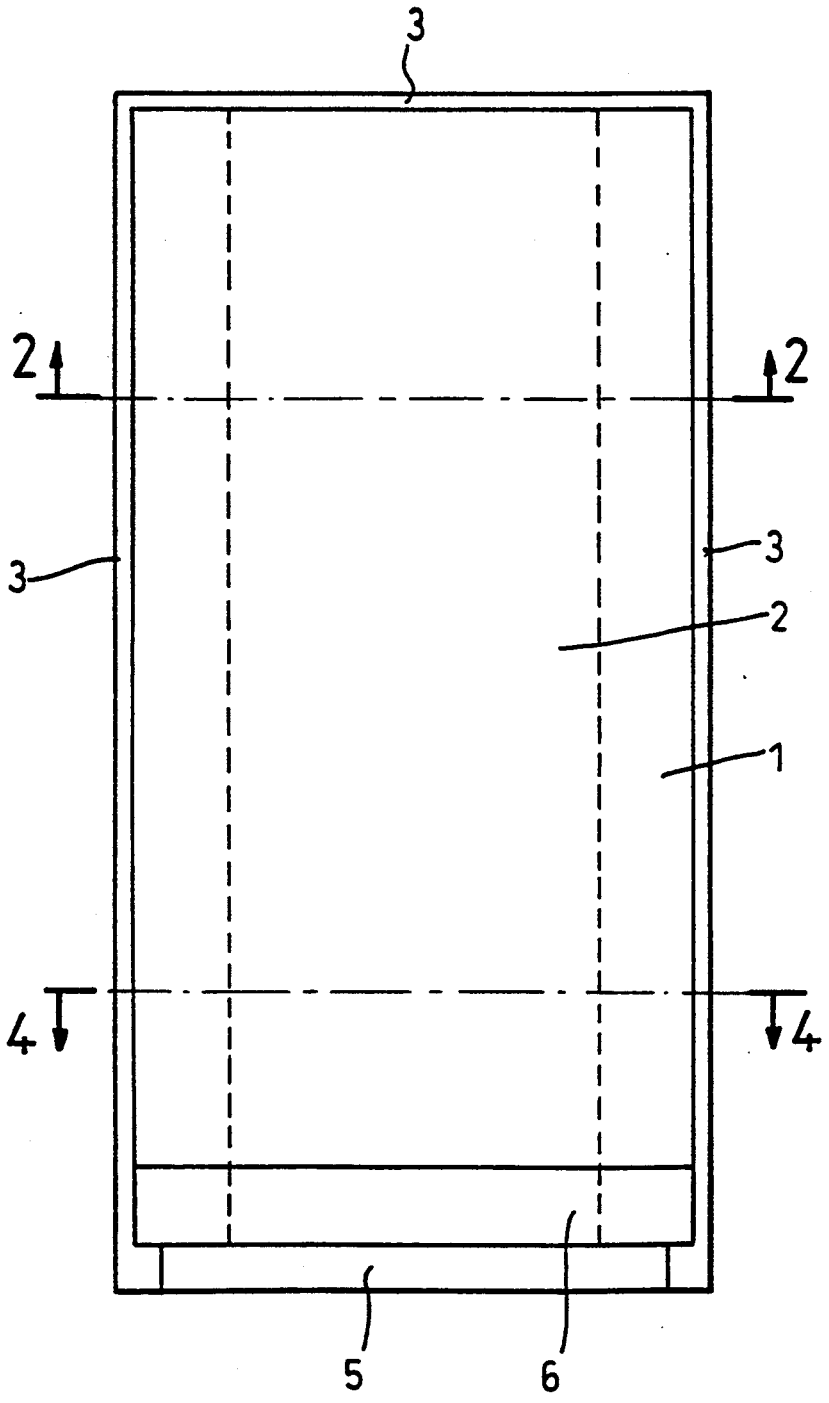
FIG. 1 shows a plan view of the billiard table according to the invention.

According to FIG. 1, the billiard table has a substantially planar playing surface 2, retention edges 3 and 5 which can be of variable height and a concave playing surface 1 which is disposed between the longitudinal retention edges 3 and the planar playing surface 2. The concavity of the playing surface 1 is a function of its radius of curvature R which is defined in the following manner: a line perpendicular to the surface of playing table 2 is provided, which passes through the point of intersection between the concave playing surface 1 and the planar playing surface 2. There is obtained thus the straight line D of FIG. 2. On this straight line, from the point of intersection between the surface of the concave playing surface 1 and the planar playing surface 2, there is marked off a distance R comprised between 0.30 and 1.1 meter. This distance permits determining the positioning of the center of the circle which permits tracing the radius of curvature of the concave portion of the playing surface. Thus, in FIG. 2, the center of the circle is designated C.

Relative to this concave playing surface the longitudinal retention edges can have various forms. Thus, the longitudinal retention edges 3 can, in accordance with FIG. 2, have a rectilinear portion constituting the prolongation of the concave playing surface or, on the other hand, can be constituted directly by the prolongation of the concave playing surface 1, which increases the difficulty of the game because the probabilities of departure of the balls from their playing space are increased. It is also possible to provide that one of the transverse retention edges, in this event the edge 5 in FIG. 1, will be wider and less high than the other retention edges so as to constitute a rest for the player's hand when making a shot. There is thus delimited a shooting origin region for the balls designated 6 in FIG. 1, which is adjacent this retention edge 5.

The concave playing surface 1 permits quite varied game combinations in which are used to the maximum the difficulties connected with the exact estimation of the path.

Figure 5:
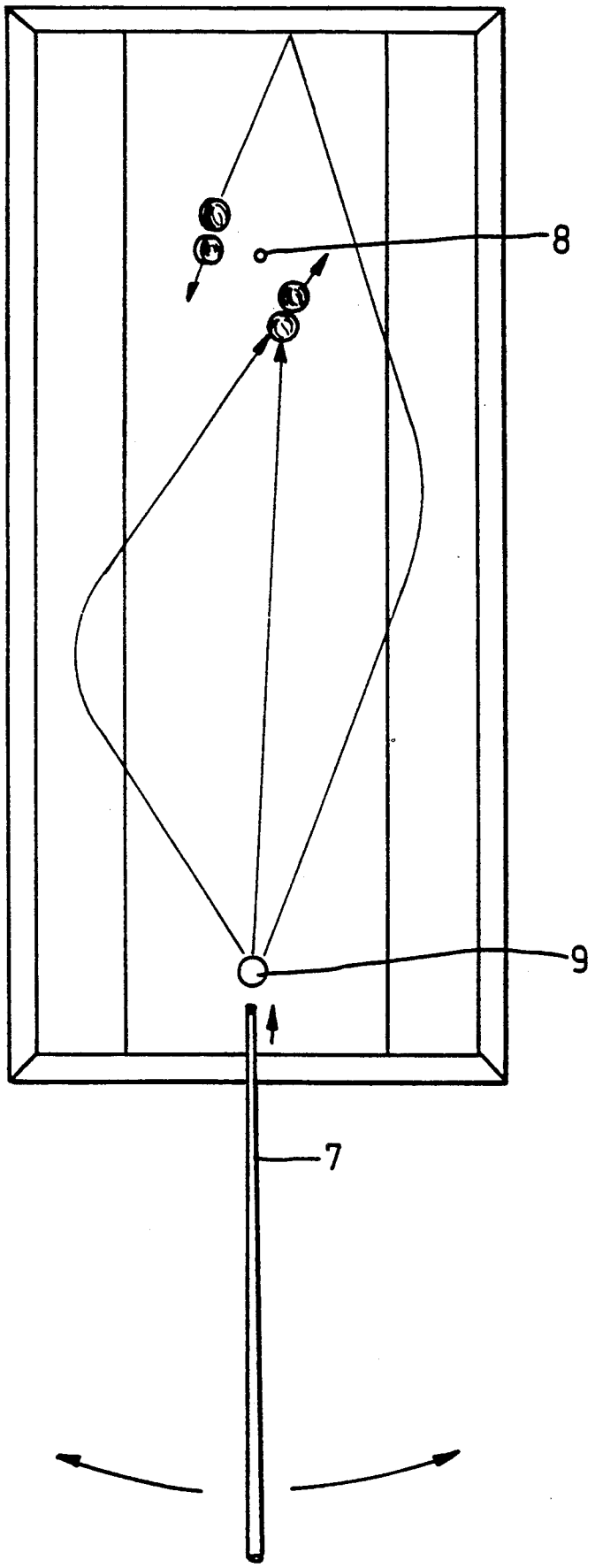
FIG. 5 shows an example of positioning the balls on the billiard table of FIG. 1.

Thus, according to FIG. 5, the object of the game can consist in shooting a certain number of balls susceptible of being distinguished from each other, from the shooting region 6 disposed adjacent the lowest edge. These balls are shot in the classical manner from the shooting area by billiard cues 7. The smallest ball 8 is shot first. The object of the game consists for each player to shoot the balls 7 so as to position them as near as possible to the smallest ball 8. To do this, the player must use both the concave and the planar playing surfaces as well as the transverse retaining edges.

Of course other playing rules could be envisaged.

It is to be noted that the invention is not limited to the embodiments described above but on the contrary encompasses all the other possible configurations within the scope of the invention.

What is claimed is:

1. A billiard table, comprising a substantially planar playing surface said playing surface being limited at its periphery by retention edges, and bordered longitudinally by a concave playing surface disposed between the planar playing surface and the longitudinal retention edges each of said concave playing surfaces (1) having a radius of curvature between 0.30 and 1.1 meters said billiard table having one of retention edges horizontally wider and vertically shorter than the other retention edges so as to constitute a rest for a layer's hand when making a billiard.

2. The billiard table according to claim 1, wherein the planar playing surface has a width between 0.50 and 1.50 meters.

3. The billiard table according to claim 1, wherein the longitudinal retention edges from a vertical extension of the concave playing surfaces (1).

4. The billiard table according to claim 3, wherein the longitudinal retention edges have a rectilinear portion forming the extension of the concave playing surfaces (1).

5. The billiard table according to claim 1, wherein the planar playing surface and the concave playing surfaces together define rolling surfaces for billiard balls propelled by cues.

* * * * *